US009235944B1

(12) United States Patent
Montagutelli

(10) Patent No.: US 9,235,944 B1
(45) Date of Patent: Jan. 12, 2016

(54) THERMAL PRINTING DEVICE FOR ELECTRONIC VOTING APPARATUS

(71) Applicant: APS TRADING OOD, Botevgrad (BG)

(72) Inventor: Denis Montagutelli, Angers (FR)

(73) Assignee: APS TRADING OOD, Botevgrad (BG)

( * ) Notice: Subject to any disclaimer, the term of this patent is extended or adjusted under 35 U.S.C. 154(b) by 0 days.

(21) Appl. No.: 14/770,310

(22) PCT Filed: Feb. 21, 2014

(86) PCT No.: PCT/EP2014/053431
§ 371 (c)(1),
(2) Date: Aug. 25, 2015

(87) PCT Pub. No.: WO2014/131703
PCT Pub. Date: Sep. 4, 2014

(30) Foreign Application Priority Data

Mar. 1, 2013 (EP) ..... 13157369

(51) Int. Cl.
*B41J 11/00* (2006.01)
*G07C 13/00* (2006.01)
*B41J 11/70* (2006.01)

(52) U.S. Cl.
CPC *G07C 13/00* (2013.01); *B41J 11/70* (2013.01)

(58) Field of Classification Search
USPC ..... 347/171, 218, 220–222; 400/578, 621; 101/66
See application file for complete search history.

(56) References Cited

U.S. PATENT DOCUMENTS 4,757,329 A * 7/1988 Sato ..... B65C 11/0289 101/66
5,150,130 A * 9/1992 Sato ..... B41J 3/4075 347/222
6,113,292 A * 9/2000 Unno ..... B41J 2/32 400/578
7,154,521 B2 * 12/2006 Shimoda ..... B41J 2/32 347/222

FOREIGN PATENT DOCUMENTS

EP 1477939 A1 11/2004
FR 2749289 A1 12/1997
FR 2786727 A1 6/2000
JP S6398451 A 4/1988

OTHER PUBLICATIONS

International Search Report for Application No. PCT/EP2014/053431, mailed Jun. 2, 2014.

* cited by examiner

*Primary Examiner* — Kristal Feggins
(74) *Attorney, Agent, or Firm* — Marshall, Gerstein & Borun LLP

(57) ABSTRACT

A thermal printing device for electronic voting apparatus including a casing with paper reservoir for receiving a paper roll, an openable external lid with a transparent window for observing of a printed part of the paper, a thermal printing unit with a driving rubber roller for the paper, a cutting device with two blades, a paper transport unit for transporting the paper, arranged below the transparent window, and a ballot discharge opening of the casing provided after the paper transport unit. The rubber roller and one of the blades of the cutting device are integral with part of the paper transport unit that is openable in order to give access to the paper reservoir.

13 Claims, 7 Drawing Sheets

THERMAL PRINTING DEVICE FOR ELECTRONIC VOTING APPARATUS

CROSS-REFERENCE TO RELATED APPLICATION

The present application is the US national phase of International Patent Application No. PCT/EP2014/053431, filed Feb. 21, 2014, which application claims priority to European 13157369.3, filed Mar. 1, 2013. The priority application, EP 13157369.3, is hereby incorporated by reference.

TECHNICAL FIELD OF THE INVENTION

The invention relates to a thermal printing device for electronic voting system.

PRIOR ART

Electronic voting apparatuses are used in different kinds of elections. In the process of voting using such electronic voting apparatus, the voter:

- first selects the candidate he/she intends to vote for;
- then the printer of the voting apparatus prints a coupon (ballot) corresponding to the voter's choice;
- the printed coupon is presented to the voter usually under a transparent glass; and
- after the voter's confirmation, the coupon is then cut and ejected into the ballot box.

In the voting application, the printer does not have only to print the ballot but also transport it under a transparent window to get the voter's approval. Then the paper ballot is ejected into a ballot box. In some applications the printer of the voting apparatus has also to perform a journal printout at the end of the voting session.

European patent application EP1477939A1 discloses a printing system for electronic voting. The system comprises a frame with paper roll holder, a printing mechanism, a paper transport unit with belts, a housing with a transparent window and a ballot box. In such voting systems one of the main problems is paper loading that should be quick, easy and secured.

In the past years the paper loading in thermal printers has been moving from automatic paper loading to easy loading where the rubber roller of the printing head is a part of a cover giving access to the paper roll reservoir.

The automatic paper loading involves inserting the paper between the rubber roller and the thermal head of the printer. A sensor detecting these conditions triggers the printer motor start, making the rubber roller turns, then moving the paper trough the printer between the thermal printhead and the rubber roller.

The easy paper loading involves having the rubber roller integral with the cover giving access to the paper reservoir. When opening such cover, the rubber roller moves away from the thermal head, and gives a full access to the paper reservoir. The paper roll can be then easily substituted, and the cover can be closed again, pinching the paper between the rubber roller and the thermal printhead. The printer is then ready to print again.

Thermal printers with easy paper loading are known for example from FR2786727A1 and FR2749289A1.

Printing devices for voting machines are known for being also able to print a journal when the election is closed. In this case the paper exit direction is changed from the ballot box to an external exit in order to present this printout.

SUMMARY OF THE INVENTION

The target of the invention is to improve the paper loading in thermal printers for voting machines. In particular, an object is to provide a compact and secure thermal printing device with simple construction and to minimize the number of parts in order to decrease the overall cost of such a printer.

Another object of the invention is to provide thermal printing device for voting machine also able to perform a journal printout at the end of the voting session. Such operation has to be secured in order to prevent inserting a ballot trough the paper journal exit.

These two objectives of are achieved by the thermal printing device for electronic voting apparatus according to the present invention that comprises a casing with paper reservoir for receiving a paper roll, an openable external lid with a transparent window for observing of a printed part of the paper, a thermal printing unit, a paper transport unit for transporting the paper, arranged below the transparent window, and a ballot discharge opening of the casing provided after the paper transport unit, wherein the thermal printing unit comprises a thermo-printing head and a driving rubber roller for the paper that is integral part of the paper transport unit and the paper transport unit is openable in order to give access to the paper reservoir.

According to a variant of the present invention the openable external lid is pivotally connected with the casing by a hinge arranged on one of the opposite ends of the openable external lid with respect to paper transport direction. Preferably the device further comprises a means for secure locking of the openable external lid.

According to a further variant of the thermal printing device it further comprises a cutting device with two blades arranged after the thermal printing unit and before the paper transport unit, wherein one of the blades of the cutting device is integral part of the paper transport unit.

Advantageously the paper transport unit is pivotally mounted on an ejection roller for the printed paper.

Preferably the paper transport unit comprises at least one paper transport belt held between at least two pulleys, said belt being in contact with the ejection roller in order to eject the paper after its presentation to the voter.

Advantageously the transparent window is arranged at a close distance to the belts of the paper transport unit to ensure flat presentation of the printed paper and avoid light reflection. Preferably at least one spring and at least one corresponding spring loaded shaft are mounted under the upper part of the belt in order to create at least one contact point between the belt and the transparent window.

According to another embodiment of the thermal printing device it further comprises a journal paper exit provided after the paper transport unit and arranged close to the ballot discharge opening. Advantageously a paper exit selector means is provided after the paper transport unit for alternatively and simultaneously closing and respectively opening of the ballot discharge opening or the journal paper exit and for redirecting of the printed paper to a ballot box via the ballot discharge opening or outside the thermal printing device via the journal paper exit. Preferably the paper exit selector is mounted pivotally and co-axially with the ejection roller.

The paper exit selector means according to this embodiment allows both easy redirecting of the printed paper and securing the work of the device.

According to further embodiment of the thermal printing device the paper transport unit is actuated by a driving motor of the thermal printing unit through the driving rubber roller. Such arrangement allows reducing the costs for the motor for the paper transport unit

BRIEF DESCRIPTION OF THE DRAWINGS

The characteristics of the invention will be disclosed in details in the following description of preferred embodiments, given as a non-restrictive example, with reference to the attached drawings wherein.

DETAILED DESCRIPTION OF PREFERRED EMBODIMENTS

Figure 1:
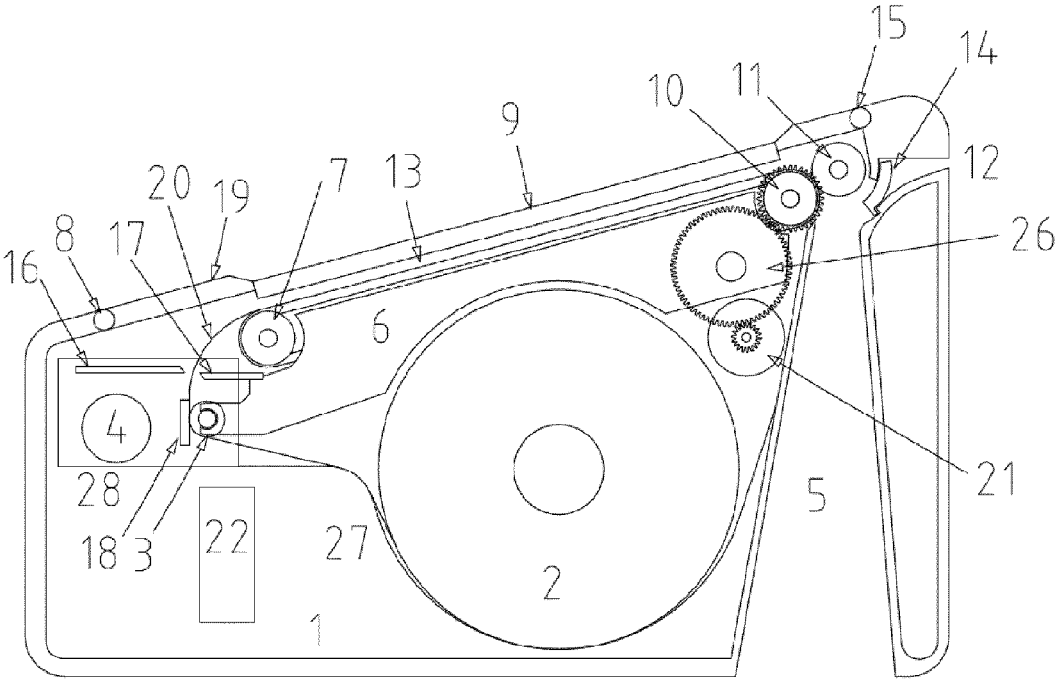
FIG. 1 is a schematic sectional view of a preferred embodiment of the thermal printing device for electronic voting apparatus according to the present invention.

FIG. 1 shows a preferred embodiment of the thermal printing device for electronic voting apparatus according to the present invention. The thermal printing device comprises a casing 1 with paper reservoir 27 for receiving a paper roll 2, an openable external lid 19 with a transparent window 9 for observing of a printed part of the paper, a thermal printing unit 28, a paper transport unit 6 for transporting the paper, arranged below the transparent window 9, and a ballot discharge opening 5 of the casing provided after the paper transport unit 6. A cutting device comprising two blades 16 and 17 able to cooperate to cut the paper is arranged after the thermal printing unit 28 and before the paper transport unit 6.

The thermal printing unit 28 comprises a thermo-printing head 18, a driving rubber roller 3 for the paper and a driving motor 4.

The paper transport unit 6 comprises at least one paper transport belt 13 held between at least two pulleys 7 and 10 mounted on a frame. At the paper exit end the belt 13 is in contact with an ejection roller 11 in order to eject the printed and sawn coupon. The paper transport unit 6 is mechanically driven by a motor 21 trough an intermediary gear 26 engaged with a gear train integral with the pulley 10. The paper transport unit 6 is intended to transport the printed paper under the transparent window 9 and then to the paper exit end.

One electronic board 22 is driving the entire printing device and ensures the communication with the host.

In the present embodiment, the driving rubber roller 3 and one of the blades 17 of the cutting device are integral with the paper transport unit 6. The paper transport unit 6 is openable in order to give access to the paper reservoir 27. In the present embodiment, the paper transport unit 6 is pivotally mounted on the ejection roller 11 for the printed paper.

In the present embodiment, the openable external lid 19 is pivotally connected with the casing 1 by a hinge 8 arranged on the end of the openable external lid 19 that is close to the thermal printing unit 28. In this arrangement the openable external lid 19 and the paper transport unit 6 are openable in opposite directions.

In a variant of this embodiment the hinge 8 is arranged on the side of the openable external lid 19 that is close to the ejection roller 11 of the paper transport unit 6. In this arrangement the openable external lid 19 and the paper transport unit 6 are openable in one and the same direction.

In order to avoid unwished and unauthorized access to the inner part of the printing device the openable external lid 19 is provided with a means 15 for secure locking. The means 15 for secure locking could be for example a keylock arranged on that end of the openable external lid 19 opposite to the hinged end 8 as shown on FIG. 1.

Figure 2:
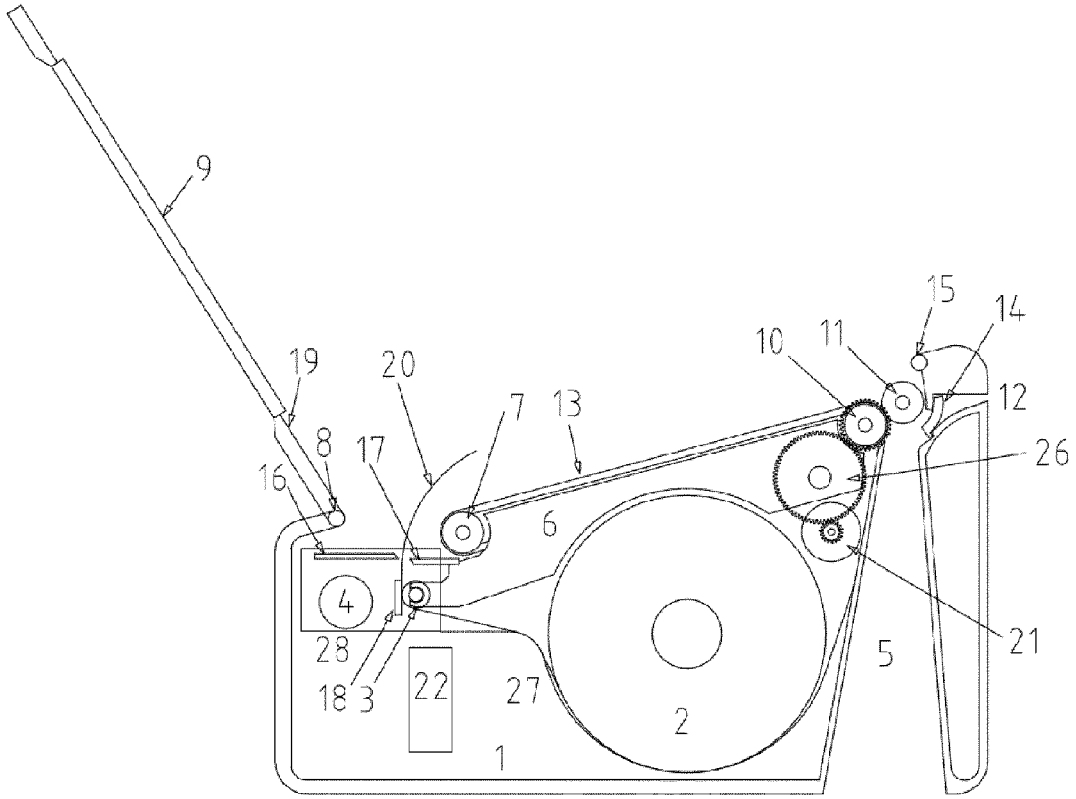
FIG. 2 is a schematic sectional view of the variant of FIG. 1 with openable external lid opened.

To have access to the paper reservoir 27 in a first step it is necessary to open the external cover 19 trough its rotation around the hinge 8 as shown on FIG. 2.

Figure 3:
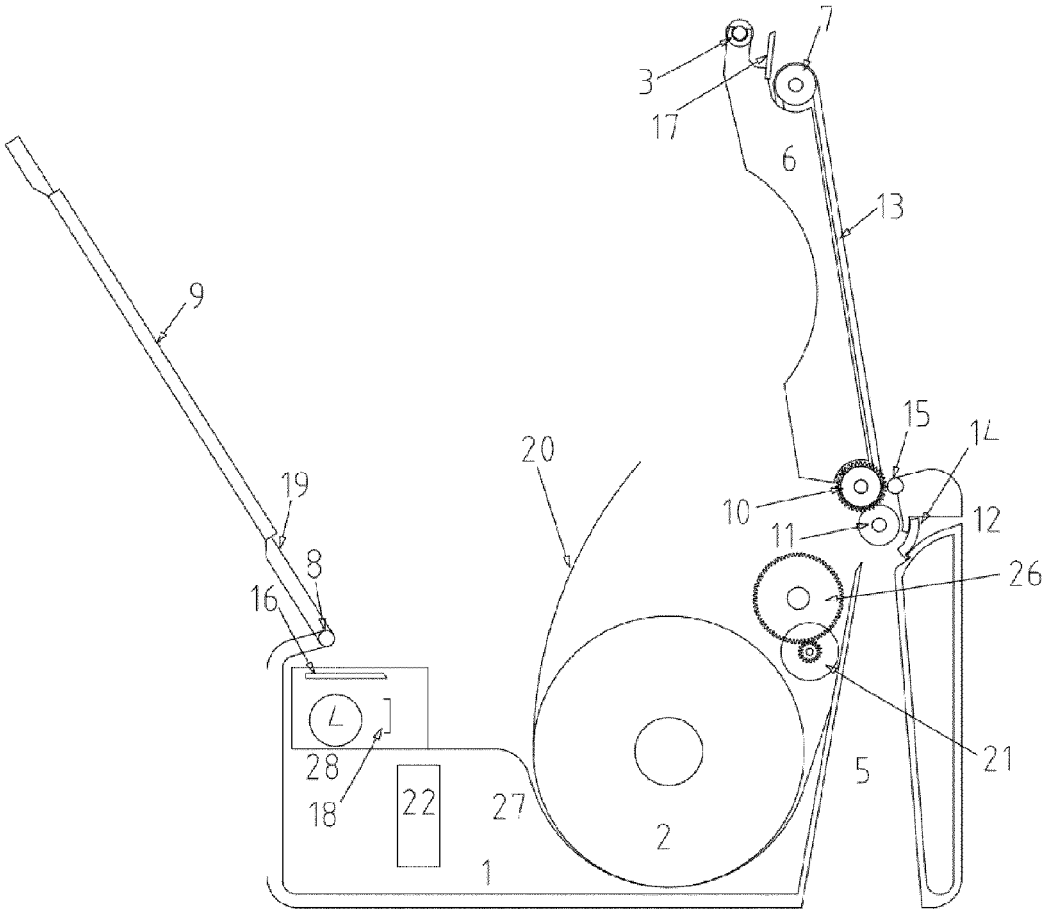
FIG. 3 is a schematic sectional view of the variant of FIG. 1 with opened paper transport unit.

In a second step, the paper transport unit 6 with the driving rubber roller 3 and the blades 17 should be opened by rotation around the ejection roller 11, giving access to the paper reservoir 27 for easy paper roll change as shown in FIG. 3.

When the paper transport unit 6 opens the gear train that is integral with the pulley 10 separates from the intermediary gear 26.

Such arrangement allows combining the easy loading with the transport function, providing to the printer an easy loading characteristics.

Figure 5:
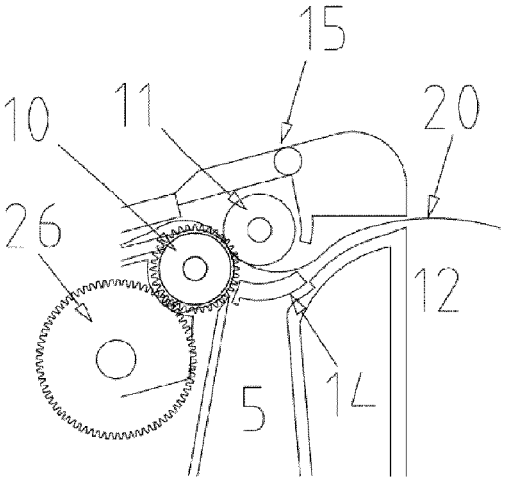
FIG. 5 is the same view as in FIG. 4 with ballot discharge opening closed by the paper exit selector means and printed paper directed outside the thermal printing device via the journal paper exit.
Figure 7:
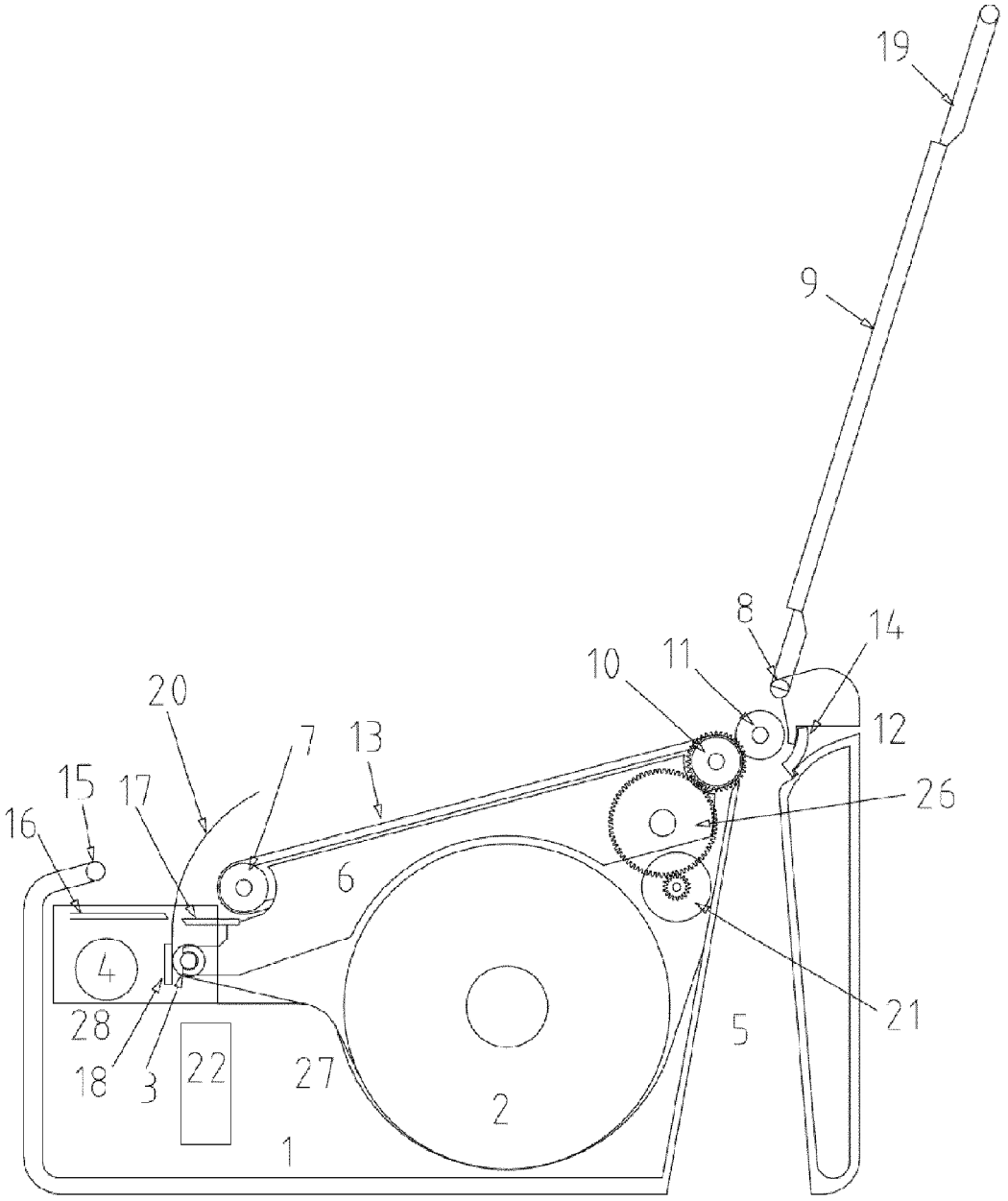
FIG. 7 is a schematic sectional view of an alternative embodiment of the thermal printing device for electronic voting apparatus of the present invention with the openable lid pivotally connected with the casing by a hinge arranged close to the ejection roller for the printed papers.
Figure 8:
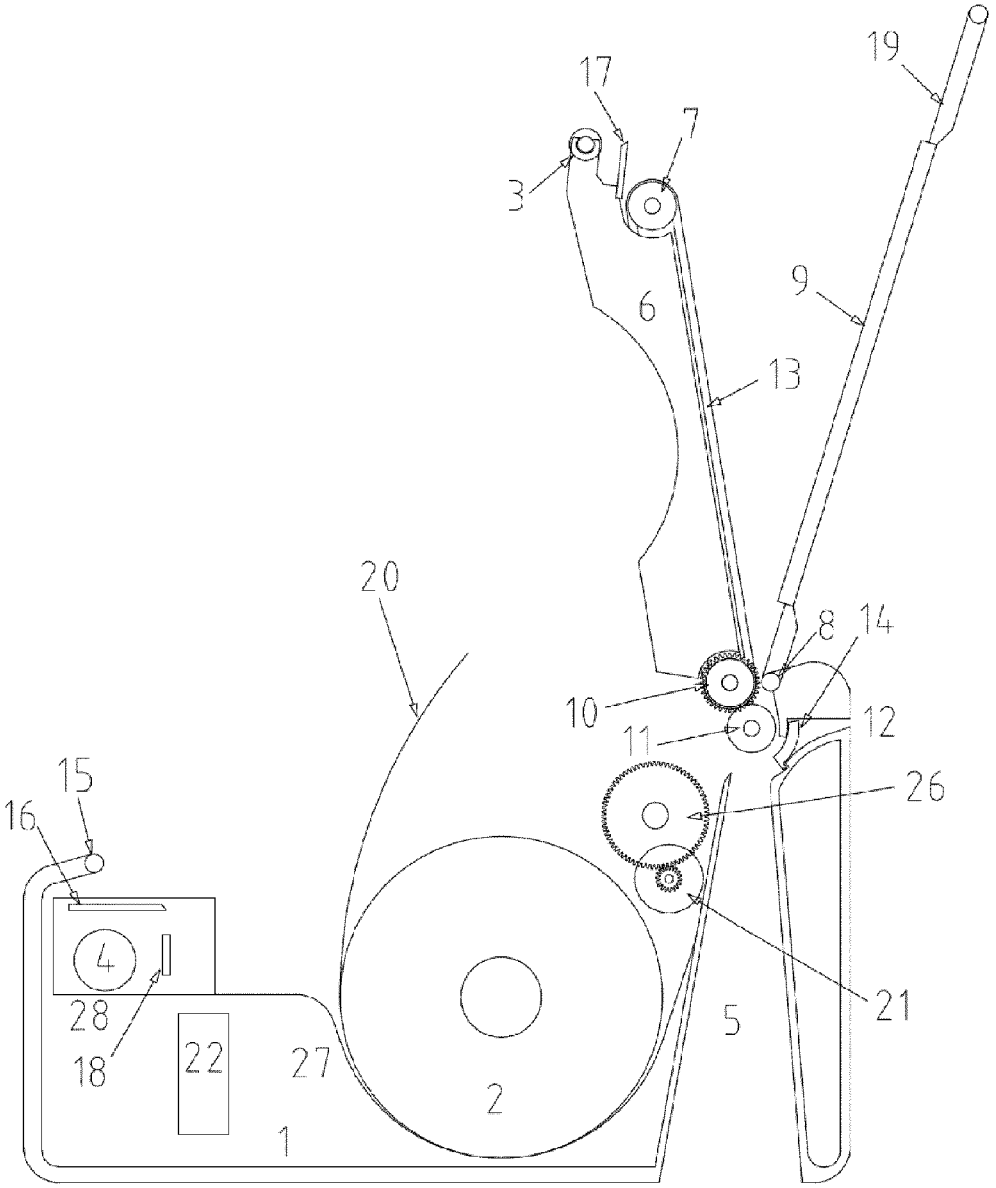
FIG. 8 is a schematic sectional view of further variant of the thermal printing device for electronic voting apparatus according to the present invention with the openable lid pivotally connected with the casing by a hinge arranged close to the ejection roller for the printed paper.

In a preferred embodiment the thermal printing device further comprises a journal paper exit 12 provided after the paper transport unit 6 and arranged close to the ballot discharge opening 5. The journal paper exit 12 is needed when a voting journal, a report or other information should be printed and ejected out of the device. In order to secure this function of the device a paper exit selector means 14 is provided after the paper exit end of the paper transport unit 6. As shown on FIGS. 5 and 6 the paper exit selector means 14 is movable between two position in order to alternatively close and respectively open the ballot discharge opening 5 or the journal paper exit 12 so as when one of the two openings is open the other is fully closed. At the same time the paper exit selector means 14 serves for redirecting of the printed paper 20 to a ballot box via the ballot discharge opening 5 or outside the thermal printing device via the journal paper exit 12.

Preferably the paper exit selector 14 is mounted pivotally and co-axially with the ejection roller 11.

In another preferred embodiment the transparent window 9 is arranged at a close distance to the upper part of the belts 13 of the paper transport unit 6 in order to present the ballot to the voter for voter's validation, and such a close distance is needed in order to keep the paper flat during the ballot presentation, to avoid parasitic reflection and to ensure a good ballot transport. The space between the transparent window 9 and the belts 13 is about 1 mm.

Figure 6:
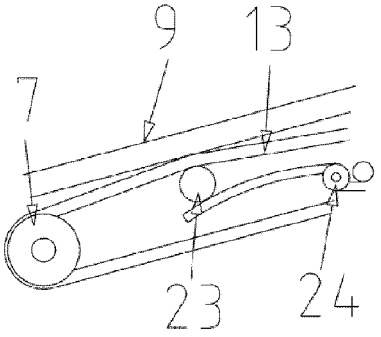
FIG. 6 is a detailed schematic sectional view of a part of the paper transport unit arranged below the transparent window of the openable lid.

In order to improve the traction force of the paper transport unit 6 and as shown on FIG. 6, at least one spring 24 and at least one corresponding spring loaded shaft 23 are mounted under the upper part of the belt 13 in order to create at least one contact point between the belt 13 and the transparent window 9. The spring loaded shaft 23 applies soft pressure on the belt 13 against the transparent window 19 limiting the potential friction and wearing between the belt and the window. Adjusting the spring force ensures a high flexibility in the paper transport traction force.

Figure 9:
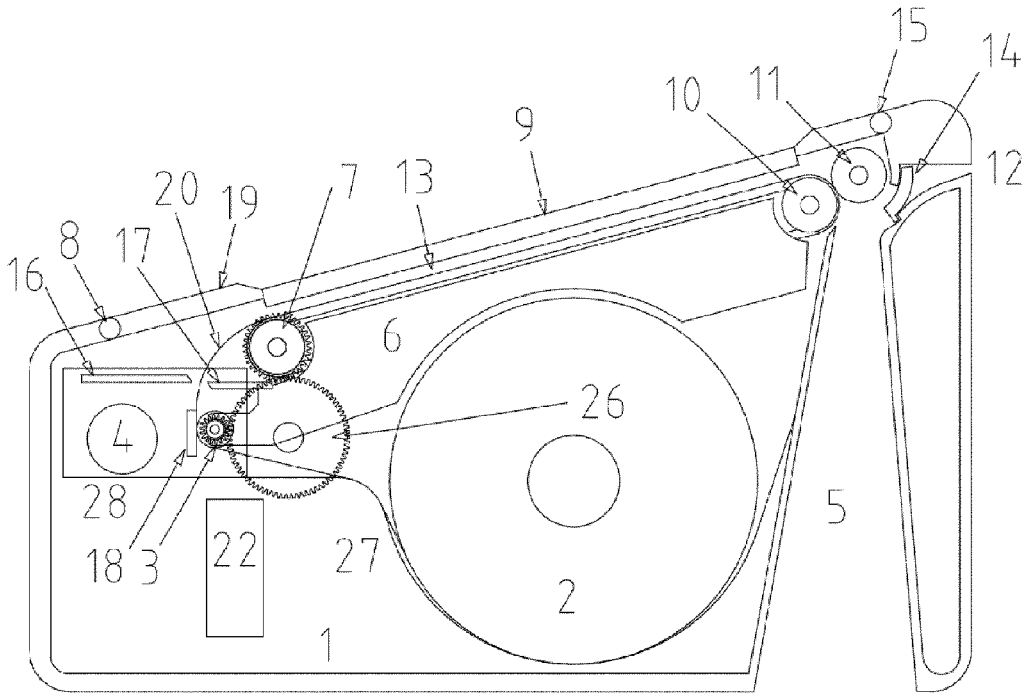
FIG. 9 is a schematic sectional view of further variant of the thermal printing device for electronic voting apparatus according to the present invention with different actuation of the paper transport unit.

In a further embodiment of the invention presented on FIG. 9, the paper transport unit 6 is mechanically driven by the driving motor 4 of the thermal printing unit 28 through the driving rubber roller 3 in order to remove the motor 21. In this non limiting example, the intermediary gear 26 is arranged between and engages gear trains integral respectively with the pulley 7 and with the driving rubber roller 3. This arrangement allows a further cost reduction of the device.

The thermal printing device according to the present invention operates as follows:

In order to load the paper roll 2 in the paper reservoir 27 of the device both the openable external lid 19 and the paper transport unit 6 should be successively opened. When the paper roll 2 is loaded then the paper transport unit 6 should be closed so as the end part of the paper 20 is pressed between the thermo-printing head 18 and the driving rubber roller 3. Then the openable external lid 19 should be closed and secured by the keylock 15.

When the thermal printing unit 28 starts printing simultaneously the motor 21 starts moving the pulley 10 at a same or higher speed than the one of the printing unit. The paper 20 is taken onto the belt 13 at the pulley 7 and starts to progress under the window 9. A small space around one millimeter is left between the window 9 and the belts 13 in order to keep the paper close to the window 9 to have a clear readability and avoid parasitic reflection on the glass.

The same or higher speed of the motor 21 helps the paper to remain flat and make it progress under the window 9. When the printout is done the motor 21 stops and the paper is cut by the blades 16 and 17.

Figure 4:
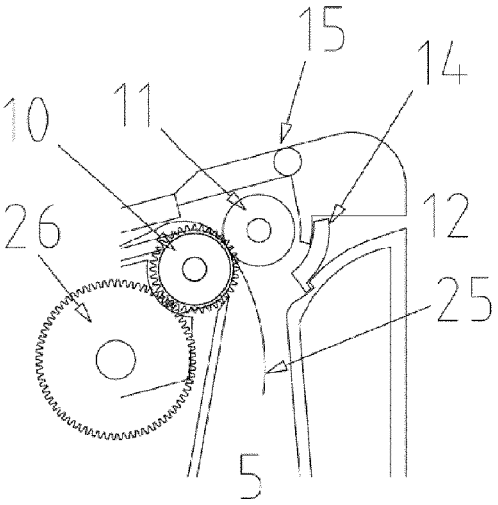
FIG. 4 is a detailed schematic sectional view of paper exit end of the paper transport unit with journal paper exit closed by the paper exit selector means and printer paper ballot directed to a ballot box.

In ballot mode of the device, at this stage, the printed ballot is presented to the voter for validation. After that the ballot 25 is caught between the pulley 10 and the ejection roller 11 and is ejected via the ballot discharge opening 5 to the ballot box as shown on FIG. 4. In this mode the paper exit selector means 14 closes the journal paper exit 12 so as no paper can be inserted trough it in the device.

In journal mode of the device the paper exit selector means 14 moves to a second position closing the ballot discharge opening 5 and redirecting the printed paper out of the thermal printing device via the journal paper exit 12.

Various modifications and/or additions of parts will be apparent to those skilled in the art that will remain within the field and scope of the present invention defined in appended claims. All the parts may further be replaced with other technically equivalent elements.

The invention claimed is:

1. A thermal printing device for electronic voting apparatus comprising a casing with paper reservoir for receiving a paper roll, an openable external lid with a transparent window for observing of a printed part of the paper, a thermal printing unit, a paper transport unit for transporting the paper, arranged below the transparent window, and a ballot discharge opening of the casing provided after the paper transport unit, wherein the thermal printing unit comprises a thermo-printing head and a driving rubber roller for the paper, the driving rubber roller is being an integral part of the paper transport unit and the paper transport unit being openable in order to provide access to the paper reservoir.

2. The thermal printing device according to claim 1, the openable external lid being pivotally connected with the casing by a hinge arranged on one of the opposite ends of the openable external lid with respect to paper transport direction.

3. The thermal printing device according to claim 1, further comprising a means for securely locking the openable external lid.

4. The thermal printing device according to claim 1, further comprising a cutting device with two blades arranged after the thermal printing unit and before the paper transport unit.

5. The thermal printing device according to claim 4, one of the blades of the cutting device being an integral part of the paper transport unit.

6. The thermal printing device according to claim 1, the paper transport unit being pivotally mounted on an ejection roller for the printed paper.

7. The thermal printing device according to claim 6, the paper transport unit comprising at least one paper transport belt held between at least two pulleys (7 and 10), said at least one belt being in contact with the ejection roller in order to eject the paper after its presentation to the voter.

8. The thermal printing device according to claim 1, the transparent window being arranged at a close distance to the belt of the paper transport unit to ensure flat presentation of the printed paper and avoid light reflection.

9. The thermal printing device according to claim 8, at least one spring and at least one corresponding spring loaded shaft being mounted under the upper part of the belt in order to create at least one contact point between the belt and the transparent window.

10. The thermal printing device according to claim 1, further comprising a journal paper exit provided after the paper transport unit and arranged close to the ballot discharge opening.

11. The thermal printing device according to claim 10, further comprising a paper exit selector means movable between two positions for alternatively and simultaneously closing and respectively opening of the ballot discharge opening or the journal paper exit and for redirecting of the printed paper to a ballot box via the ballot discharge opening or outside the thermal printing device via the journal paper exit.

12. The thermal printing device according to claim 11, the paper exit selector being mounted pivotally and co-axially with the ejection roller.

13. The thermal printing device according to claim 1, the paper transport unit being actuated by a driving motor of the thermal printing unit through the driving rubber roller.

* * * * *